US009345301B2

(12) United States Patent
Brouard et al.

(10) Patent No.: US 9,345,301 B2
(45) Date of Patent: May 24, 2016

(54) SUPPORTED COMPOSITE TOOL PACK

(71) Applicant: Veto Pro Pac, LLC, Norwalk, CT (US)

(72) Inventors: Roger Brouard, Norwalk, CT (US); Lee Griswold, Bethel, CT (US); Rui Henriques, Wolcott, CT (US); Ken Benson, Southbury, CT (US)

(73) Assignee: Veto Pro Pac, LLC, Norwalk, CT (US)

( * ) Notice: Subject to any disclaimer, the term of this patent is extended or adjusted under 35 U.S.C. 154(b) by 87 days.

(21) Appl. No.: 14/142,857

(22) Filed: Dec. 29, 2013

(65) Prior Publication Data

US 2014/0239024 A1 Aug. 28, 2014

Related U.S. Application Data

(60) Provisional application No. 61/769,219, filed on Feb. 26, 2013.

(51) Int. Cl.

| | |
|---|---|
| ***A45F 3/04*** | (2006.01) |
| ***A45C 13/36*** | (2006.01) |
| *A45C 13/02* | (2006.01) |
| *A45F 3/14* | (2006.01) |

(52) U.S. Cl.

CPC . *A45C 13/36* (2013.01); *A45F 3/04* (2013.01); *A45C 2013/026* (2013.01); *A45F 2003/146* (2013.01); *A45F 2200/0575* (2013.01)

(58) Field of Classification Search

CPC ... A45F 3/04; A45F 2200/0575; A45C 13/02; A45C 13/026; A45C 13/36

USPC ..... 224/627; 206/372, 373

See application file for complete search history.

(56) References Cited

U.S. PATENT DOCUMENTS

| | | | | | |
|---|---|---|---|---|---|
| D198,236 | S | * | 5/1964 | Schaefer | D3/308 |
| 3,960,300 | A | * | 6/1976 | Dickler | 224/629 |
| 4,720,021 | A | * | 1/1988 | Byrns | 220/764 |
| D314,279 | S | * | 2/1991 | Hotchkiss | D3/309 |
| 5,090,604 | A | | 2/1992 | Howe | |
| D325,280 | S | * | 4/1992 | Nelson | D3/309 |
| D329,135 | S | * | 9/1992 | Embree | D3/308 |

(Continued)

FOREIGN PATENT DOCUMENTS

EP 2233254 A1 9/2010

OTHER PUBLICATIONS

International Search Report and Written Opinion mailed Apr. 17, 2014 (PCT/US2013/078168).

*Primary Examiner* — Justin Larson
(74) *Attorney, Agent, or Firm* — Alix, Yale & Ristas, LLP

(57) ABSTRACT

A supported composite tool pack according to aspects of the disclosure includes a concave plastic base coupled to a durable fabric body. A substantially rigid support panel divides the interior of the pack and supports the fabric body and contents of the pack with respect to the base. The pack includes a pair of backpack straps permitting the pack to be worn on the back of a user, while keeping both hands free for opening doors, hatches or scaling ladders. The fabric body defines a plurality of organizational structures inside the pack, including but not limited to closed and open pockets, rings and clips for the placement of tools, spare parts and other equipment. The base and support panel maintain the pack and its contents in an upright and accessible position when open or closed, giving the user a stable, protected work platform no matter the environment.

16 Claims, 15 Drawing Sheets

(56) References Cited

U.S. PATENT DOCUMENTS

| | | | | |
|---|---|---|---|---|
| 5,209,384 | A | 5/1993 | Anderson | |
| D376,477 | S * | 12/1996 | Patterson, Jr. | D3/304 |
| 6,039,205 | A * | 3/2000 | Flink | 220/659 |
| D426,384 | S * | 6/2000 | Brouard | D3/276 |
| 6,126,003 | A * | 10/2000 | Brouard | 206/372 |
| 6,460,697 | B1 * | 10/2002 | Stevens | 206/225 |
| 6,571,998 | B2 * | 6/2003 | Godshaw et al. | 224/607 |
| 6,626,342 | B1 * | 9/2003 | Gleason | 224/633 |
| 6,651,853 | B2 * | 11/2003 | Higgins et al. | 224/155 |
| D487,345 | S * | 3/2004 | Brouard | D3/289 |
| D490,245 | S | 5/2004 | Brouard | |
| 6,915,902 | B2 * | 7/2005 | Brouard | 206/373 |
| 6,945,442 | B2 * | 9/2005 | Godshaw et al. | 224/607 |
| 7,165,705 | B2 * | 1/2007 | Haro | 224/629 |
| 7,350,682 | B2 * | 4/2008 | Meyer | 224/628 |
| 7,673,777 | B2 * | 3/2010 | Gleason, Jr. | 224/635 |
| D613,507 | S * | 4/2010 | Brouard | D3/315 |
| D614,404 | S * | 4/2010 | Brunner | D3/304 |
| 7,780,051 | B2 * | 8/2010 | Godshaw et al. | 224/607 |
| 8,152,037 | B2 | 4/2012 | Sabbag | |
| 8,381,956 | B2 * | 2/2013 | Gleason, Jr. | 224/645 |
| 8,403,141 | B2 * | 3/2013 | Williams et al. | 206/372 |
| 8,651,273 | B2 * | 2/2014 | Williams et al. | 206/372 |
| 8,708,206 | B2 * | 4/2014 | Onessimo et al. | 224/576 |
| D714,059 | S * | 9/2014 | Blackwell et al. | D3/304 |
| 8,833,557 | B1 * | 9/2014 | Gwynn et al. | 206/373 |
| D725,910 | S * | 4/2015 | Sampaio | D3/315 |
| 2003/0075468 | A1 * | 4/2003 | Story et al. | 206/373 |
| 2004/0065573 | A1 * | 4/2004 | Brouard | 206/373 |
| 2007/0056868 | A1 * | 3/2007 | Godshaw et al. | 206/373 |
| 2008/0073361 | A1 | 3/2008 | Brouard | |
| 2008/0179370 | A1 * | 7/2008 | Williams | 224/682 |
| 2008/0202962 | A1 * | 8/2008 | Brouard | 206/373 |
| 2008/0230416 | A1 * | 9/2008 | Brouard | 206/372 |
| 2014/0239024 | A1 * | 8/2014 | Brouard et al. | 224/259 |
| 2014/0262886 | A1 * | 9/2014 | Kinskey et al. | 206/373 |

* cited by examiner

SUPPORTED COMPOSITE TOOL PACK

BACKGROUND

The present disclosure relates to devices for organizing and transporting tools and other work implements, more specifically to a tool carrying arrangement wearable on the back of a user.

Many boxes and bags have been used to organize and carry tools and other work implements. Rigid boxes for organizing and carrying tools are well-known. Buckets and soft bags are also commonly used for storing, transporting, and accessing tools and other work implements. When using traditional boxes, buckets and bags, it can be difficult to keep tools neatly arranged for quick access. Tools can be damaged by contact with each other during transport. Further, rigid buckets and tool boxes can be difficult to carry in locations requiring the use of hands to open doors, scale ladders, etc.

Modern infrastructure includes a huge number of widely dispersed sub-systems and components that must be installed, maintained or repaired by service personnel. Such systems and components are found in every possible environment, from communications equipment on rooftops and towers to energy infrastructure in below ground tunnels and chambers. Manufacturing, office and residential structures also include widely dispersed equipment. Installation and service personnel must bring tools, diagnostic equipment and parts to the equipment, wherever it is located. Often, such work areas are wet, dirty and have restricted access. Workers and their equipment must be able to safely access rooftops, tunnels and other locations where the worker must use both hands to gain access, so carrying bags or boxes by hand is not possible.

There is a need for tool storage and transport containers that protect tools, keep them organized, allow easy access to the tools and permit the user use of both hands while transporting the tools.

SUMMARY

A supported composite tool pack according to aspects of the disclosure includes a concave plastic base coupled to a durable fabric body. A substantially rigid support panel divides the interior of the pack and supports the fabric body and contents of the pack with respect to the base. The pack includes a pair of backpack straps permitting the pack to be worn on the back of a user, while keeping both hands free for opening doors, hatches or scaling ladders. The fabric body defines a plurality of organizational structures inside the pack, including but not limited to closed and open pockets, rings and clips for the placement of tools, spare parts and other equipment. The base and support panel maintain the pack and its contents in an upright and accessible position when open or closed, giving the user a stable, protected work platform no matter the environment.

DETAILED DESCRIPTION OF THE DISCLOSED EMBODIMENTS

Figure 1:
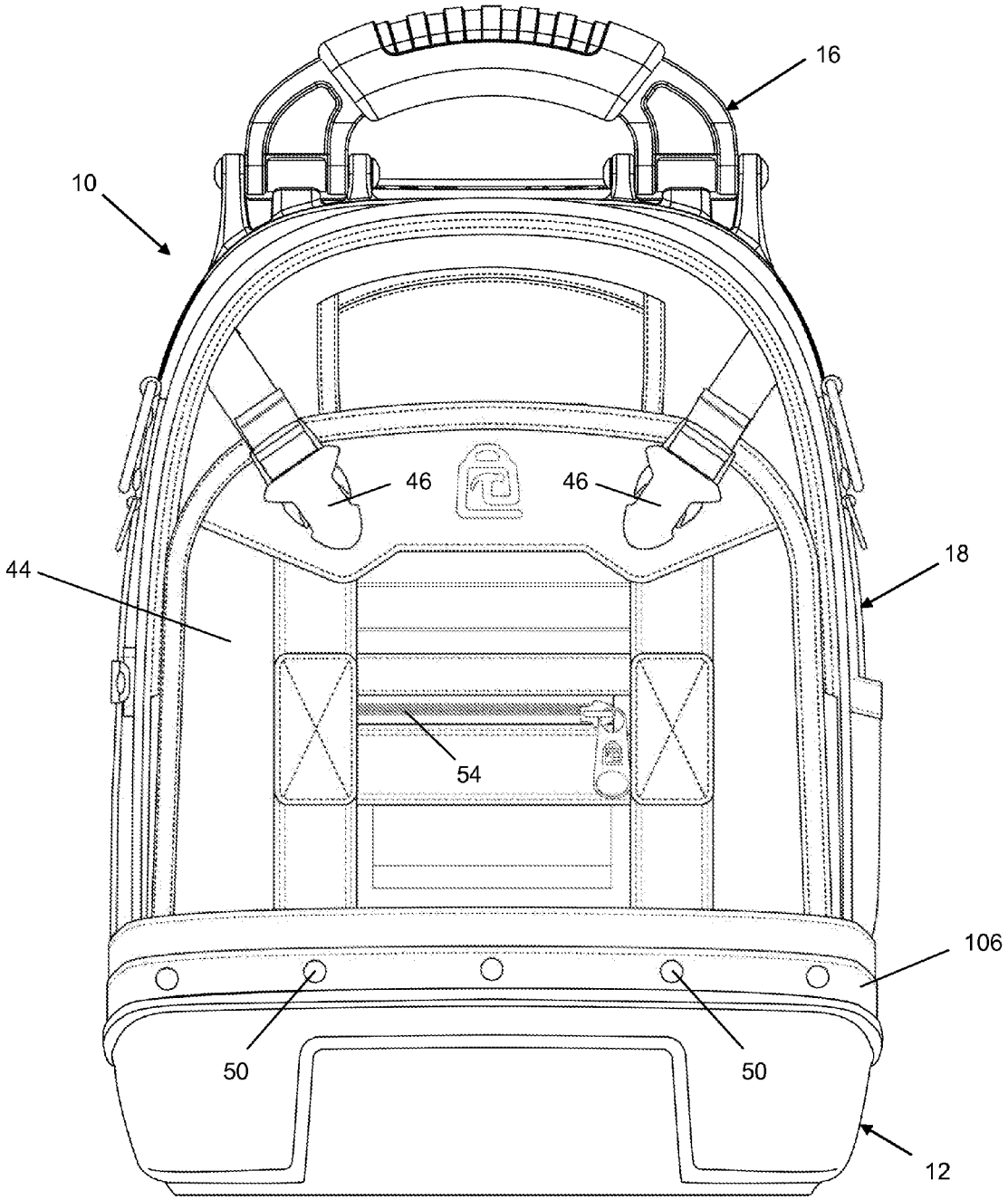
FIG. 1 is a front elevation view of a supported composite tool pack according to aspects of the present invention.
Figure 2:
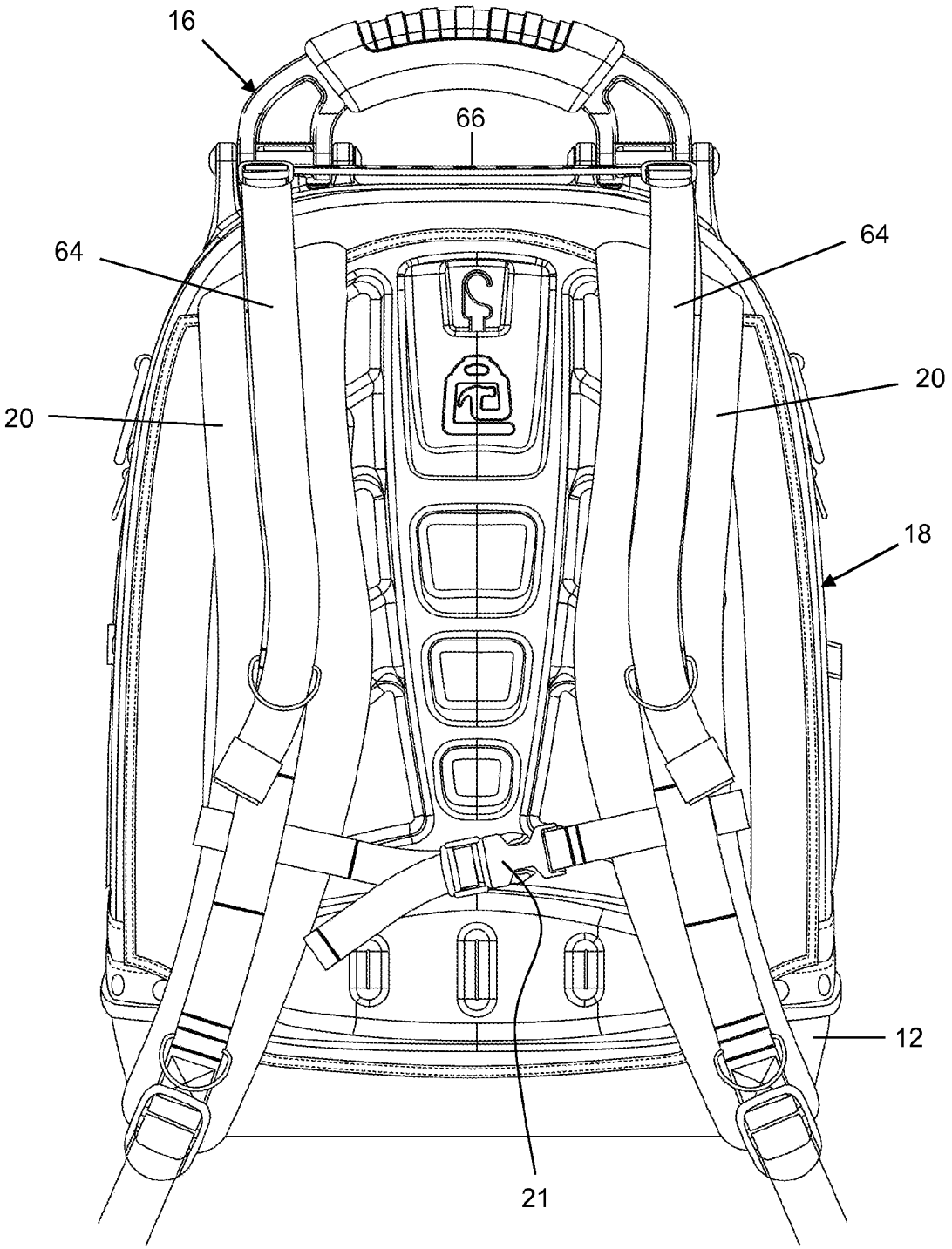
FIG. 2 is a rear elevation view of the supported composite tool pack of FIG. 1.

An embodiment of the disclosed supported composite tool pack (hereafter "the pack") will now be described with reference to FIGS. 1 through 14. The pack, designated generally by reference numeral 10, is configured in the form of a backpack. The major components of the pack 10 are a molded plastic base 12, a central support member 14, a handle assembly 16, and a fabric body 18 including backpack straps 20 permitting the pack to be worn on the back of a user. As best shown in FIGS. 5A through 5D, the pack includes both hard and soft structural components. The base 12 of the pack 10 is a molded plastic tub configured to provide a stable support surface for the pack while protecting the contents of the pack from the environment. Although a molded plastic base 12 is disclosed, other manufacturing methods (such as thermoforming) and materials may be used to provide a base according to the disclosure. The fabric body 18 is constructed of heavy duty nylon and polypropylene materials to protect the pack contents and hold up in jobsite conditions. The base 12 includes internal flanges 22 that are secured to a central support panel 14 of corrugated ABS sheet, but other suitably rigid and durable materials may also be used to form the central support panel. The central support panel 14 is configured to extend the width and height of the pack 10 and is secured to the flanges 22 of the base 12 by rivets 24 or other suitable fastener. In the disclosed embodiment, the central support panel 14 is generally centrally located between the front and rear of the pack, but is not limited to this specific location. As best shown in FIGS. 5A and 8-10, a handle assembly 16 at the top of the pack includes a downwardly projecting flange 26 that is fastened to the central support panel 14 at the top of the pack 10 by rivets. Alternatively, the central support panel 14 may be trapped in place by other components, but not secured to the base 12 or handle assembly 16. Thus, the central support panel 14 forms a supportive spine of the pack 10 extending from the molded plastic base 12 to the handle assembly 16 at the top of the pack 10. The central support panel 14 divides the pack 10 into two primary compartments, a front compartment 28 and a rear compartment 30 as shown in FIGS. 5A and 5C.

Figure 3:
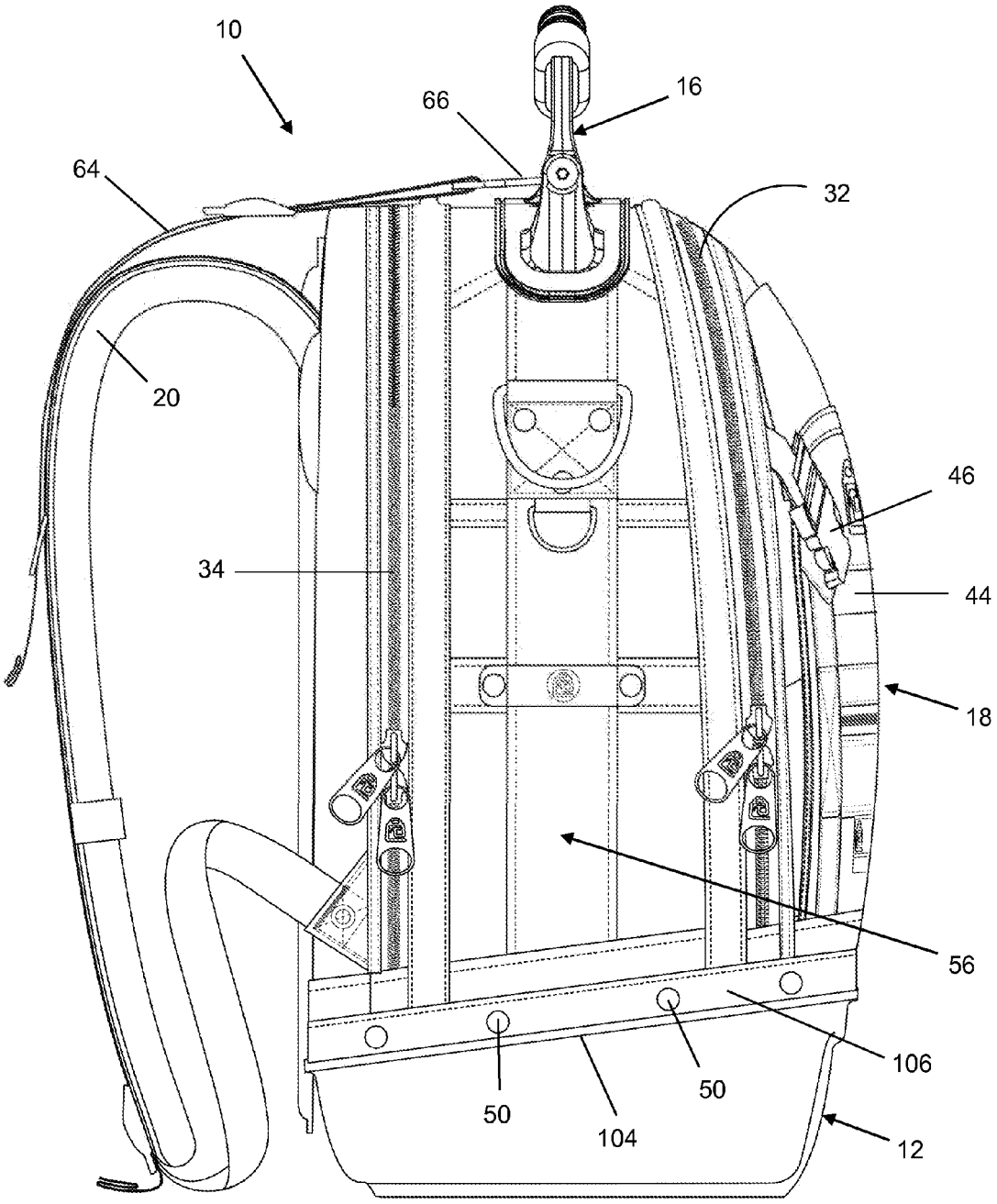
FIG. 3 is a left side view of the supported composite tool pack of FIG. 1.
Figure 4:
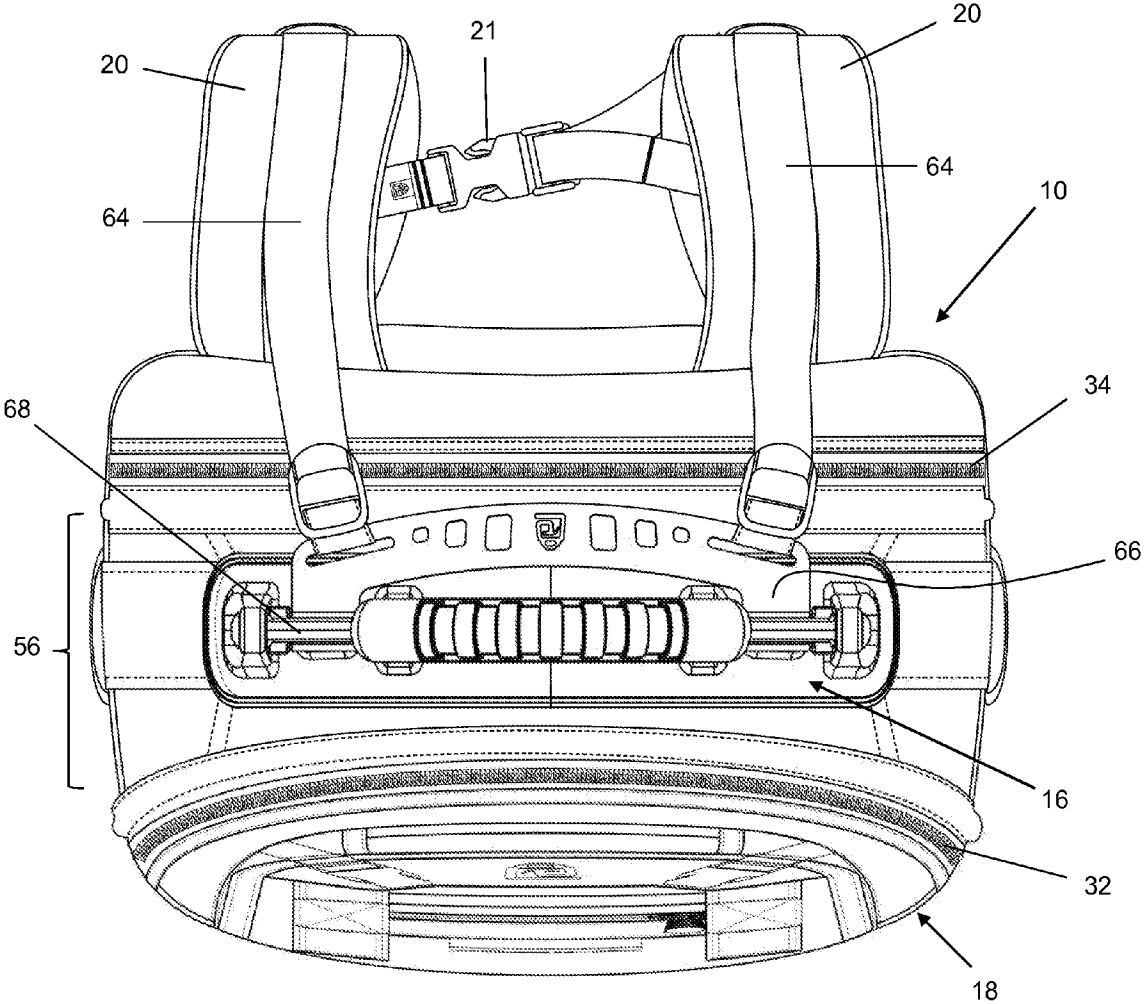
FIG. 4 is a top view of the supported composite tool pack of FIG. 1.
Figure 5A:
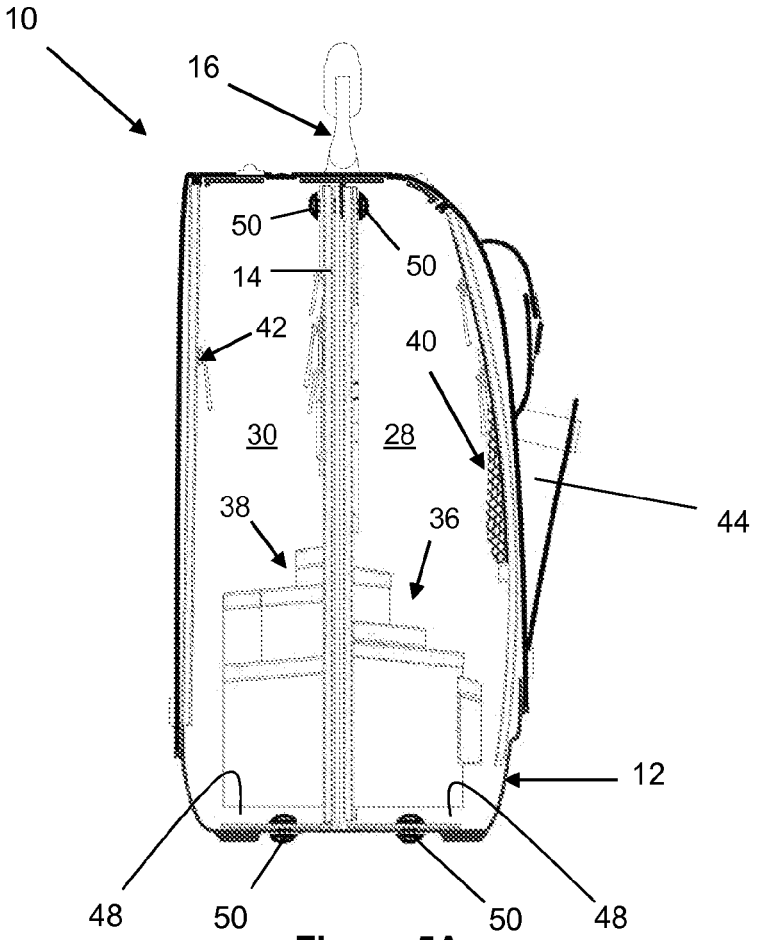
FIGS. 5A through 5D illustrate the internal structure and relationships among components of the supported composite tool pack according to aspects of the disclosure.

As best shown in FIGS. 3 and 4, the disclosed pack 10 includes two primary zippers 32, 34 allowing access to the two primary compartments, 28, 30 of the pack. Each compartment 28, 30 includes at least one surface for the organization of tools, cables, parts and components and other work implements. In the disclosed embodiment, each compartment includes two surfaces upon which tools and work implements may be organized, numbered 1-4 in FIGS. 5C and 5D. As shown in FIG. 5A, two organizational panels 36, 38 are arranged back-to-back on either side of the central support panel 14, and together with the central support panel 14 form a support extending the length and width of the pack 10. Various zippered pockets and pouches are arranged on the fabric body 18 at the inside front and rear surfaces 40, 42 of the pack to provide additional protected storage. The exterior of the fabric body 18 includes a variety of fabric pockets, zipper pockets, D rings, and a large front pocket 44 secured with straps and quick release buckles 46. Bulky items that cannot be zipped inside the front pocket 44, may be secured using the straps and buckles 46.

The central support panel 14 is substantially, but not completely rigid. The central support panel 14 is stiff enough to support the bag body 18 and the contents of the pack in a vertical orientation when the bag is resting on the base 12, but will flex when exposed to compressive or twisting forces imposed upon the bag body 18 during use. Absolute rigidity of the central support panel is not required and a variety of materials or combinations of materials may be employed to provide the support functionality of the disclosed corrugated ABS sheet. The base 12 and central support panel 14, in combination with the bag body 18, result in an upright and stable configuration which protects the contents of the pack, while providing easy access to its contents. The upright nature of the pack 10 prevents all or parts of the bag body 18 from falling to the floor or ground where it can be soiled or damaged by the jobsite environment.

The organizational panels 36, 38 secured to the central support panel are constructed of durable nylon cordura fabric stitched to 1.5 mm polyethylene (PE) backing sheet. The PE sheet provides additional support at the center of the pack and protects the central support panel 14 from damage by sharp tools that may be stored in the pockets arranged on the panels 36, 38. As best seen in FIG. 5A tiered and nested pockets are arranged on each organizational panel 36, 38, with the largest pockets at the bottom of each organizational panel. The pockets are constructed to provide a range of sizes and orientations for the storage of various tools, parts and equipment and work implements. In the disclosed embodiment, the pockets are situated so that the heaviest and bulkiest items may be situated in the large pockets at the bottom of the pack but are easily accessible via the two main zipper openings 32, 34. Each organizational panel 36, 38 also may include flat pockets and zippered enclosures for the storage of flat and or less bulky items toward the top of the pack without obstructing the view of and access to the larger items at the bottom of the pack 10. The fabric of each organizational panel 36, 38 may extend past the bottom of the PE sheet to form a flap 48. As shown in FIG. 5A the flaps 48 are arranged against the bottom of the base 12 and secured to the base by rivets 50 or other suitable fastener. At the top of the pack 10, the organizational panels 36, 38 are secured to the top end of the central support panel 14 and the flange 26 extending downward from the handle assembly 16 by a plurality of rivets 50 or other suitable fastener. Together, the organizational panels 36, 38 and central support panel 14 connect the base 12 to the handle assembly 16 and provide a semi rigid supportive structure to the pack 10. The base 12 and central support 36, 38, 14 ensure that the pack remains upright even when the internal pockets are loaded with heavy tools and equipment and work implements.

The fabric pack body 18 extends from an upper lip 52 of the base 12 to the handle assembly 16 at the top of the pack 10. The pack body 18 is constructed of durable nylon and polypropylene fabric and webbing materials. These materials are preferred because of their abrasion resistance, strength, and resistance to rot and mildew as well as many common lubricants and solvents present at worksites. Other materials having similar properties may be employed. The fabric body 18 consists of fabric panels stitched together and secured to webbing support to surround and enclose the two primary compartments 28, 30 of the pack 10. As best seen in FIG. 1 the front of the fabric body includes one or more small zippered compartments 54 for quick access. A larger zippered compartment 44 on the front of the pack can accommodate larger items for quick access. This compartment 44 is also secured by straps and quick release buckles 46. It is possible to secure larger items, such as a coil of cable to the pack 10 using the straps and buckles 46. The front of the fabric body 18 is connected to a central portion 56 by front zipper 32.

Figure 14:
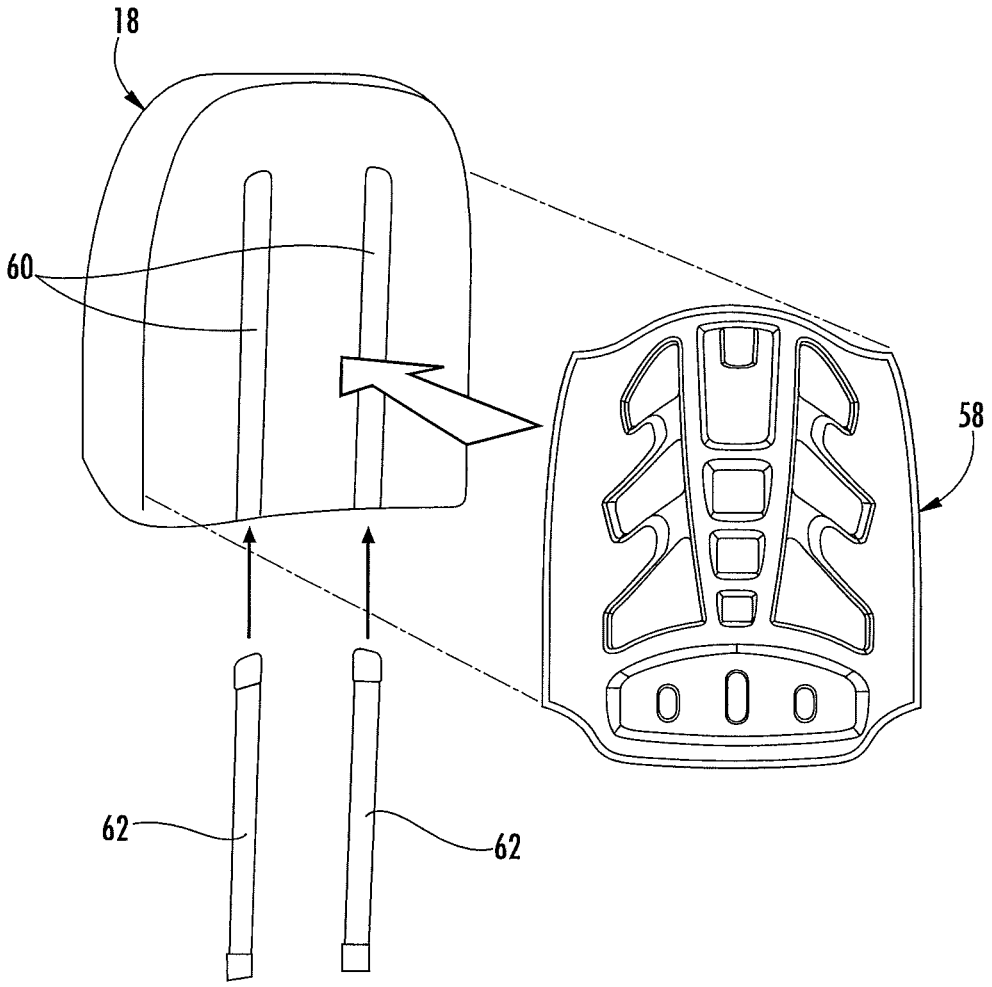
FIG. 14 is a partial, exploded view of the rear of the fabric body and back pad of the composite tool pack according to aspects of the disclosure.

As best seen in FIG. 14, the rear of the fabric body 18 includes a padded back panel 58 and backpack straps 20 with sternum strap 21. The fabric body 18 includes a pair of elongated pockets 60 for flat aluminum bars 62 which support and distribute the weight of the pack 10 during use. A thermoformed foam back cushion 58 improves the comfort of the pack during use and includes air channels to circulate air between the user and the pack 10. The rear portion of the fabric body including the backpack straps 20 is secured to the remainder of the fabric body by rear zipper 34. The backpack straps 20 are secured to the top and bottom of the rear of the fabric body 18 as shown in FIG. 3. A sternum strap 21 with quick release connector is arranged to extend between the backpack straps 20 across the chest of a user as additional support for the pack during use. The backpack straps 20 are constructed of heavy gauge durable fabric surrounding foam padding material.

With reference to FIGS. 2-4 and 13, a pair of load positioning straps 64 extend from an upper portion of the backpack straps 20 to a metal hasp 66 configured to latch with the pin 68 of the hinge assembly 16. The load positioning straps 64 serve two functions. First, the load positioning straps 64 cross the rear main zipper 34 and support the weight of the pack directly from the hinge pin 68 of the hinge assembly 16 via the hasp 66 as shown in FIGS. 3 and 4. This arrangement removes the weight of the pack 10 from bearing on the rear main zipper 34 and instead carries the weight via the hasp 66, load positioning straps 64 and backpack straps 20. Second, the load positioning straps 64 are adjustable in length, permitting the user to control the position of the pack 10 relative to the user's body. It will be noted by those familiar with the use of backpacks that it can be useful to allow a user to adjust the position of the backpack under different circumstances. For example, when walking on an inclined surface it may be useful to add length to the load positioning straps 64 and allow the weight of the pack to extend away from the user's body for balance.

Figure 7:
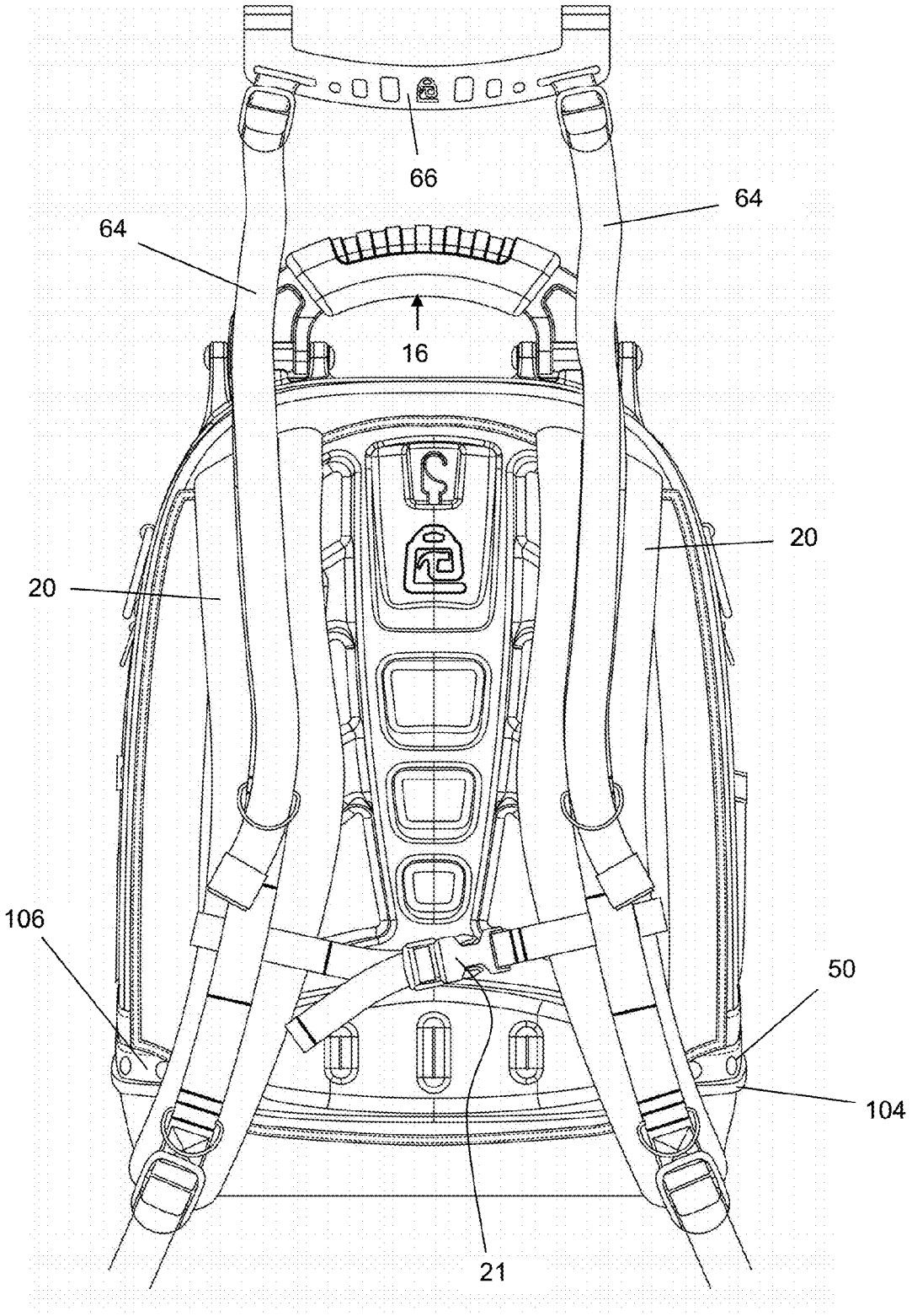
FIG. 7 is a rear view of the supported composite tool pack illustrating the strap support hasp disconnected from the hinged handle.
Figure 8A:
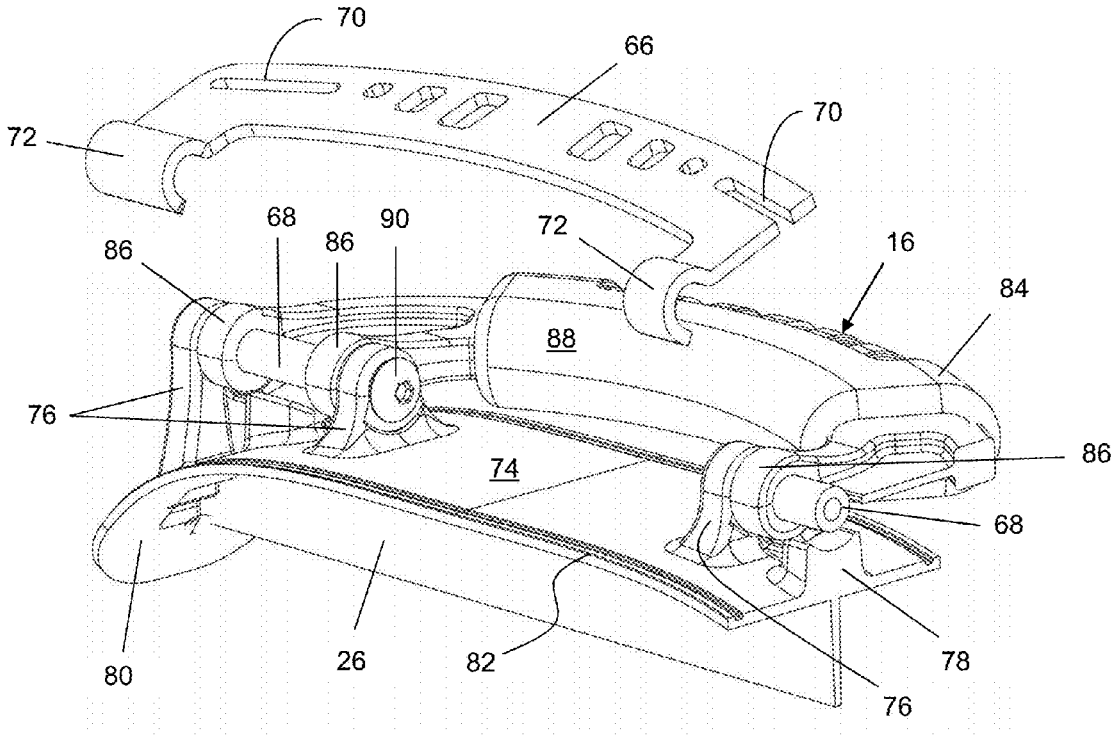
FIGS. 8A and 8B are perspective and sectional end views of the handle and hasp assembly with the hasp arranged for assembly to the hinge according to aspects of the disclosure.
Figure 8B:
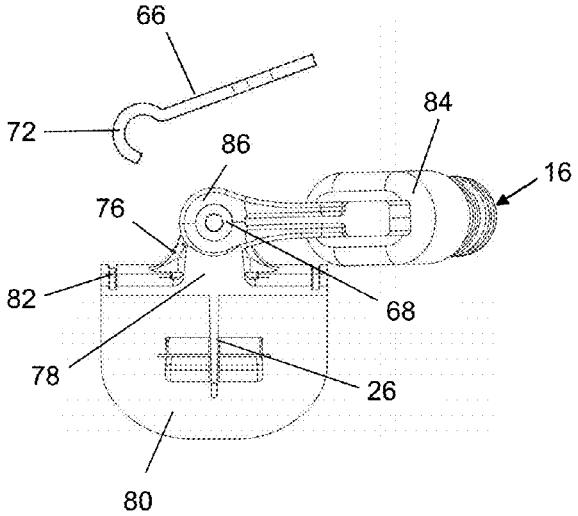
Figure 9A:
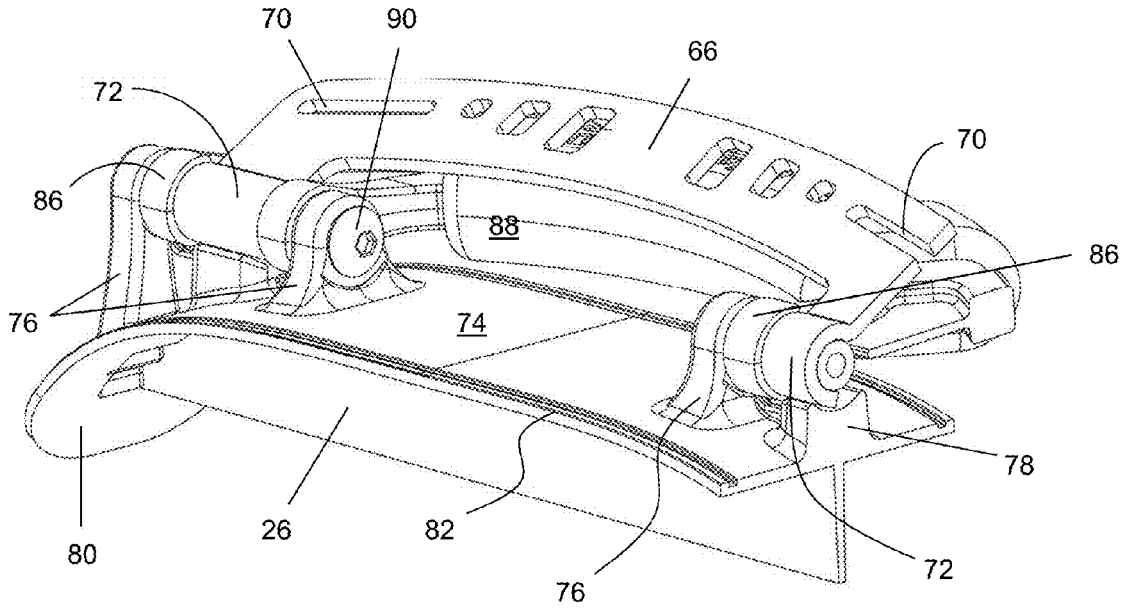
FIGS. 9A and 9B are perspective and sectional end views of the handle and hasp assembly with the hasp assembled to the hinge pin.
Figure 9B:
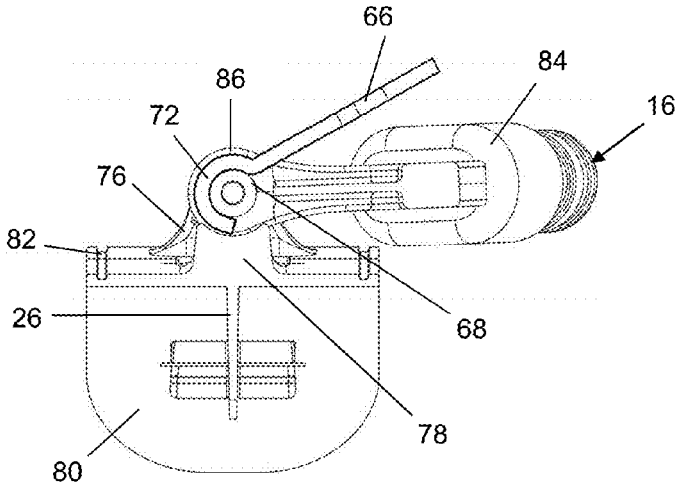
Figure 10A:
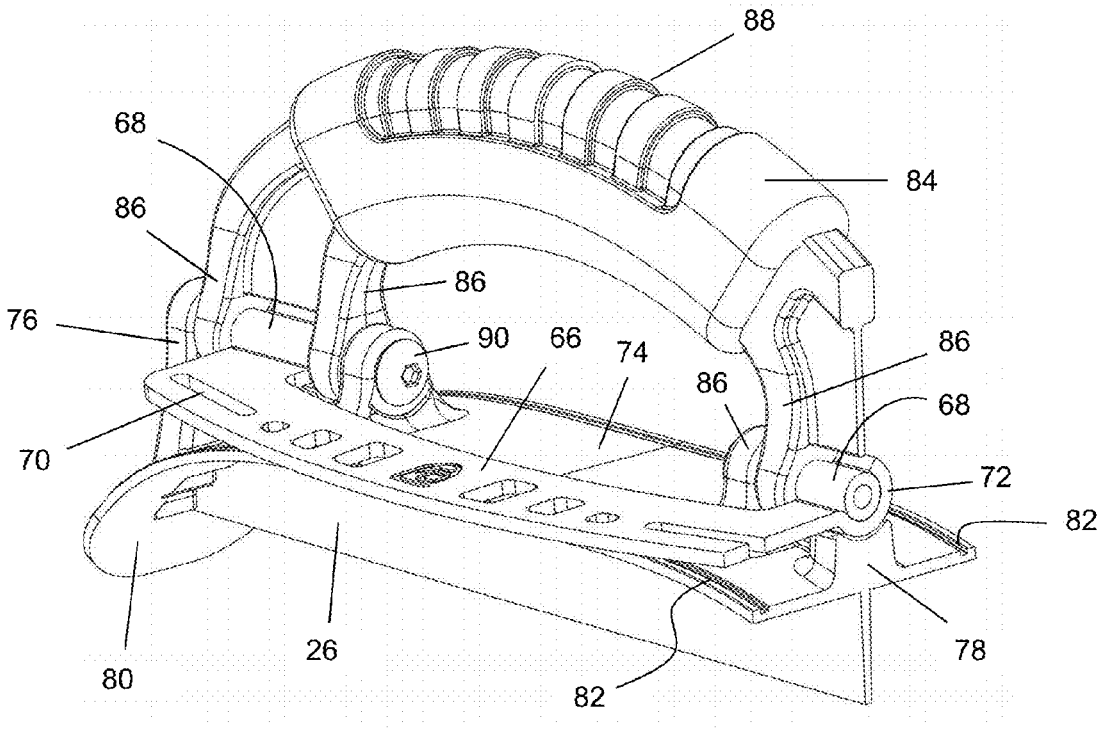
FIGS. 10A and 10B are perspective and sectional end views of the handle and hasp assembly with the hasp latched to the hinge pin.
Figure 10B:
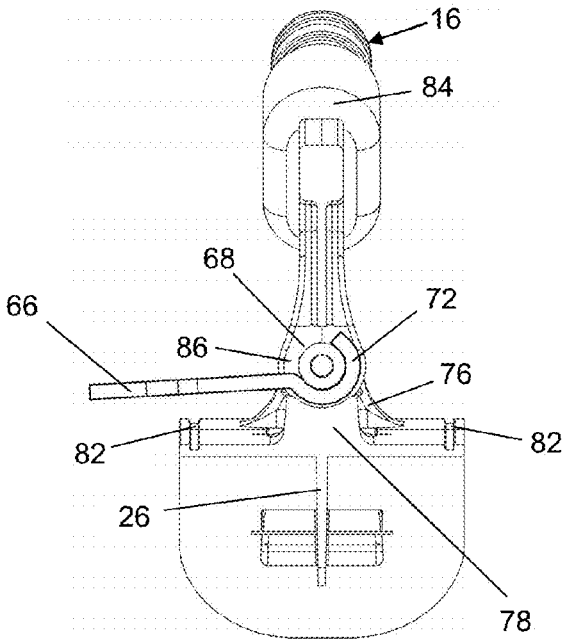

FIGS. 1-4 illustrate the hasp 66 engaged with the pin 68 of the handle assembly 16 at the top of the pack 10. FIG. 7 illustrates the hasp 66 disengaged from the handle assembly 16. FIGS. 8A-10B illustrate details of the hinge assembly 16 and the hasp 66 showing how the hasp is engaged to the hinge pin 68. As shown in FIGS. 8A and 8B, the hasp includes a connecting member with slots 70 for receiving the load positioning straps 64. The hasp 66 also includes a C shaped knuckle 72 configured to engage the hinge pin 68. The hinge assembly 16 includes a molded plastic handle body 74 which supports four pivot points 76 for the hinge pins 68. The handle body 74 supports each hinge pin 68 adjacent the pin's inner and outer ends. Between the pivot points 76, the handle body includes a cradle 78 configured to support the hasp knuckles 72 when engaged with the hinge pins 68. FIGS. 9A and 9B illustrate engagement of the hasp knuckles 72 with the hinge pins 68. The open side of each knuckle 72 passes over the hinge pin 68 with the free end of each knuckle 72 passing between the hinge pin 68 and the cradle 78. FIGS. 10A and 10B illustrate the hasp 66 fully engaged with the hinge pins 68 and in a position for use while the pack is worn by a user. The hasp 66 may only be engaged and disengaged from the hinge pins when the hasp is rotated into the position shown in FIGS. 8A and 8B. When the hasp is in the position shown in FIGS. 10A and 10B during use, the hasp 66 cannot be disengaged from the hinge pins 68.

The molded plastic handle body 74 includes a peripheral flange 80 where the handle body 74 is secured to the fabric body 18 of the pack 10. The handle body 74 also includes a downward extending flange 26 where the handle body 74 is connected to the central support panel 14 and organizational panels 36, 38 as discussed above. The peripheral flange 80 of the handle body 74 includes a groove 82 which facilitates stitching of the handle body 74 to the central arch of the fabric body 18 of the pack as best seen in FIGS. 3 and 4. A molded plastic handle 84 includes four lobes 86 each defining an opening for the hinge pin 68. The lobes 86 at each end of the handle 84 are spaced apart, exposing the hinge pins 68 and providing a space for the hasp knuckles 72 to engage the hinge pins 68. The handle 84 includes a grip 88 of softer material molded around the central portion of the handle 84 to improve the ergonomics and grip of the handle 84. In the disclosed embodiment, the hinge pin 68 is a 10 mm aluminum rod tapped at either end to receive a 6 mm screw 90. The hinge pin 68 is inserted through the hinge supports 76 and handle lobes 86 and secured in place by screws 90. The disclosed handle 84 folds flat at the top of the pack 10 when not in use as shown in FIGS. 8A and 8B.

Figure 11:
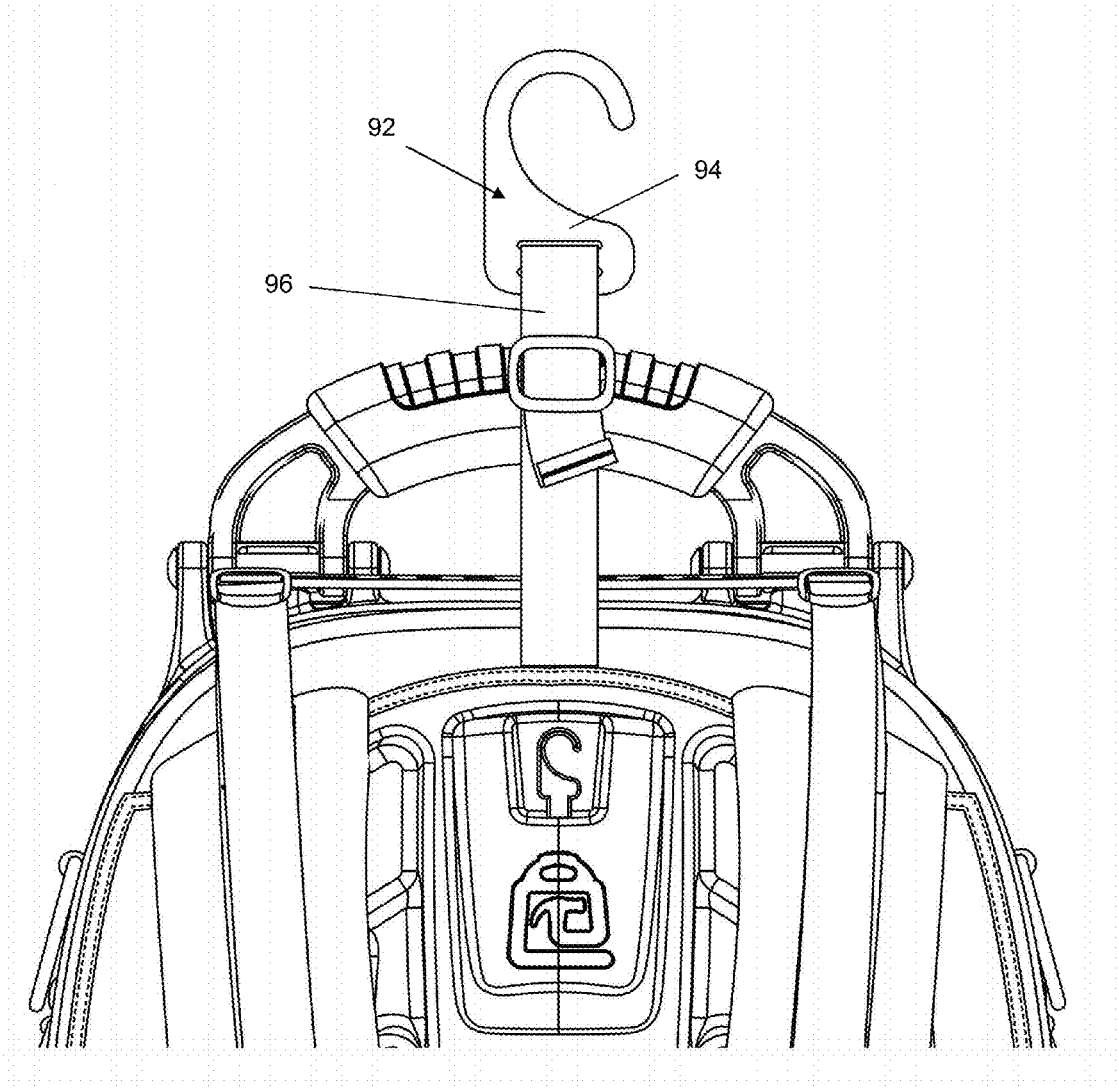
FIG. 11 is a partial rear elevation view of the supported composite tool pack showing a pack hanger extending from a pocket in the rear panel of the pack according to aspects of the disclosure.

FIG. 11 illustrates a hanger 92 that can be used to hang the pack 10 from any convenient support structure. The hanger 92 may be used to support the pack 10 off the ground when convenient or necessary to the user. The hanger 92 may also be employed to support the pack apart from the user while the user mounts or dismounts a ladder onto a roof or other structure. The hanger 92 includes a metal hook 94 constructed of material strong enough to support the weight of the pack 10 and its contents. The hook 94 is secured to the pack by an adjustable strap 96. The hook 94 and strap 96 are stored in a small pocket at the top rear of the pack when not in use.

Figure 12:
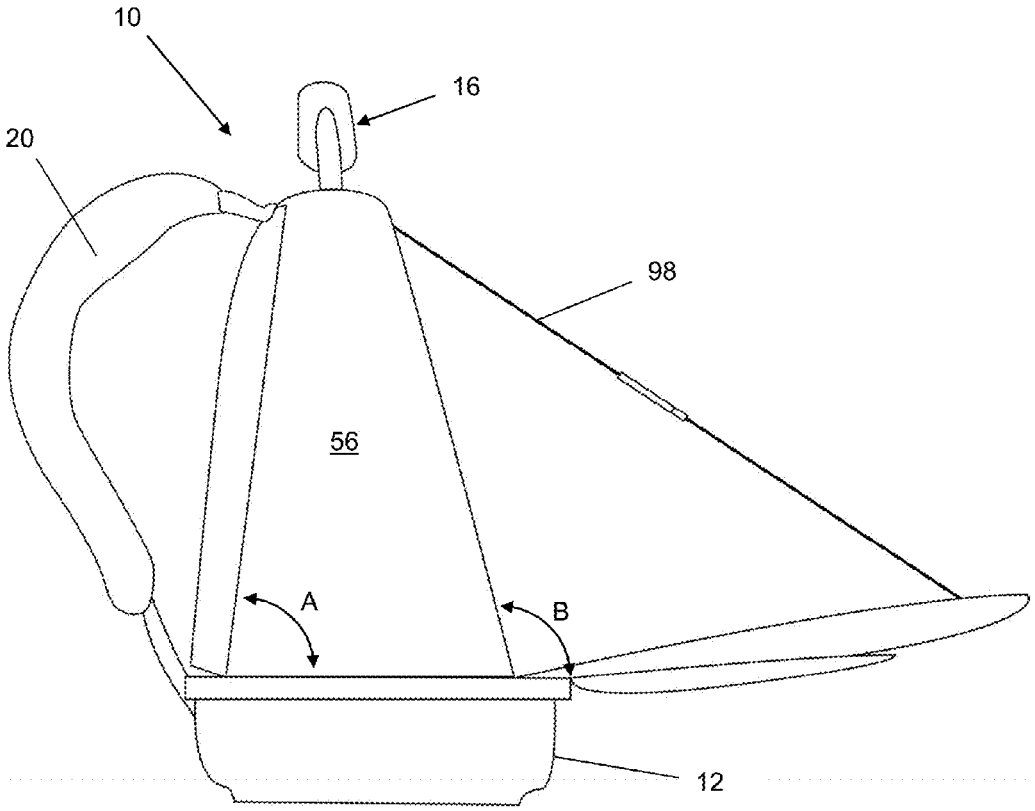
FIG. 12 is a left side view of the supported composite tool pack with the front panel of the pack deployed to provide a support shelf according to aspects of the disclosure.
Figure 13:
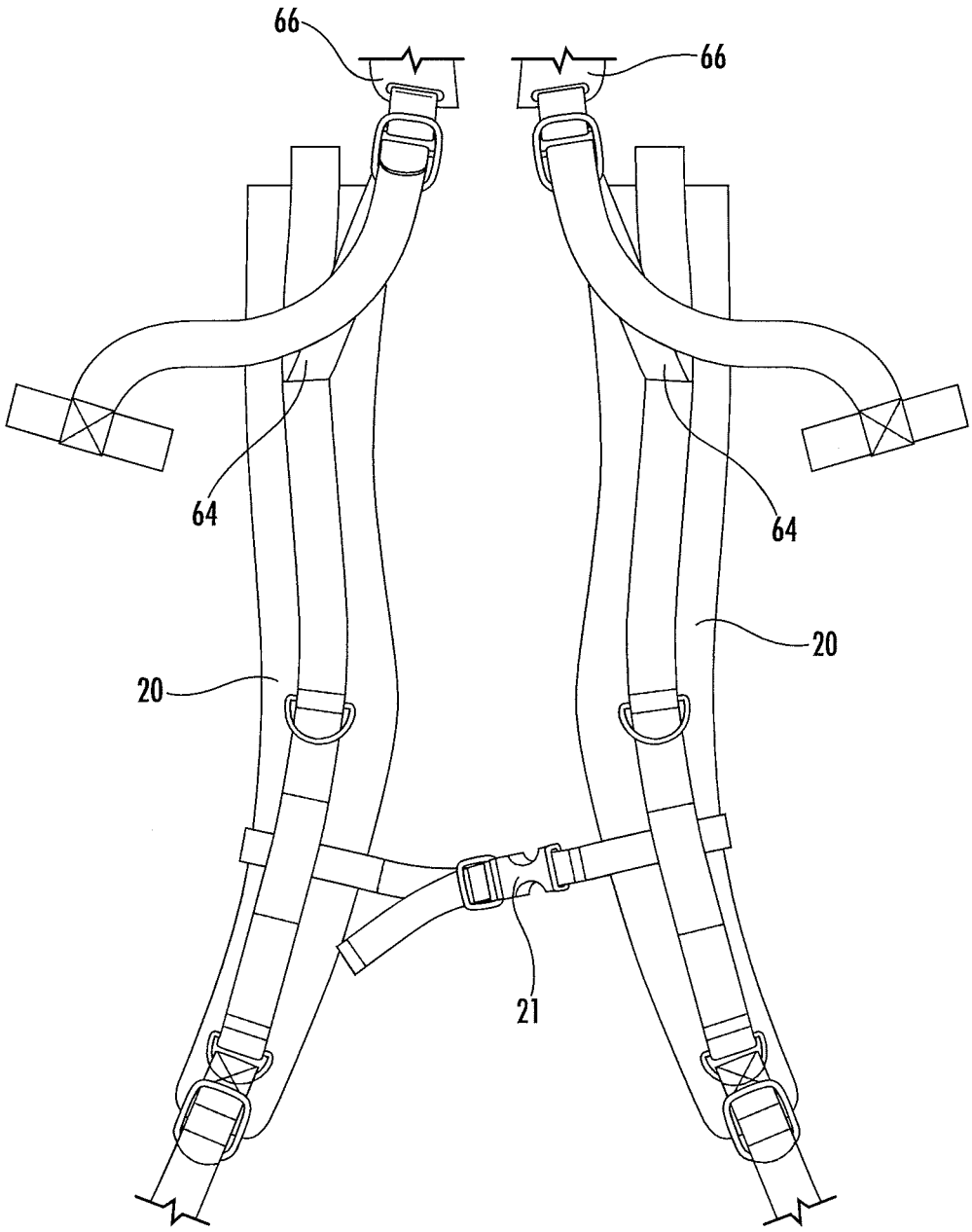
FIG. 13 is a rear view of the backpack strap assembly of the composite tool pack according to aspects of the disclosure.

FIG. 12 illustrates the pack with the front zipper 32 open and the front panel of the pack separated from the central portion 56 of the pack and secured in an open position to form a shelf. A strap 98 extends from the upper inside of the pack to the upper inside of the front panel to support the front panel during use as a shelf. The shelf can provide a handy space for temporary storage of components or tools during use.

Figure 6:
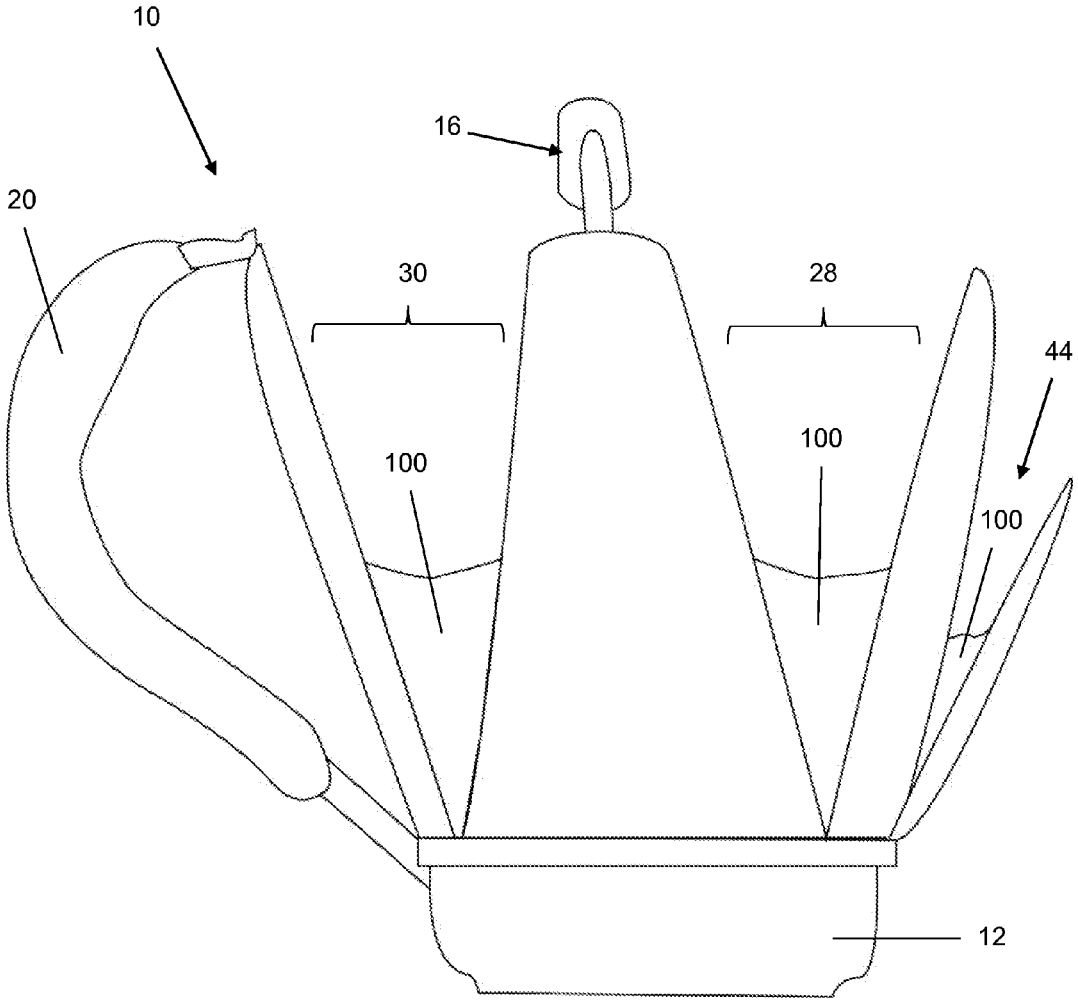
FIG. 6 is a left side view of the supported composite tool pack in an open configuration.

FIG. 6 illustrates the pack with the two main zippers 32, 34 open as well as the front auxiliary zipper open. Each of the main components of the fabric body is connected to the others by a gusset 100 at either side of the pack 10. The gussets 100 support the panels when open, preventing the fabric body 18 from collapsing to ground level which may be wet and/or dirty. The gussets 100 also prevent unnecessary stress on the main zippers 32, 34 which would result from allowing the front and rear panels of the pack 10 to open completely.

Figure 5B:
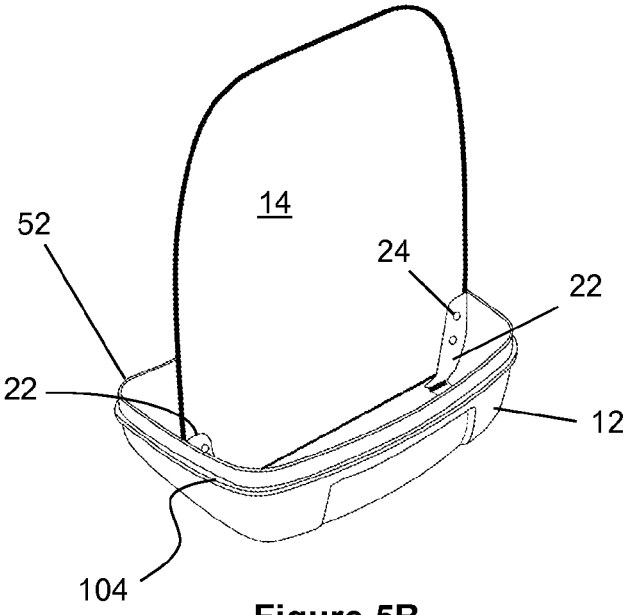
Figure 5C:
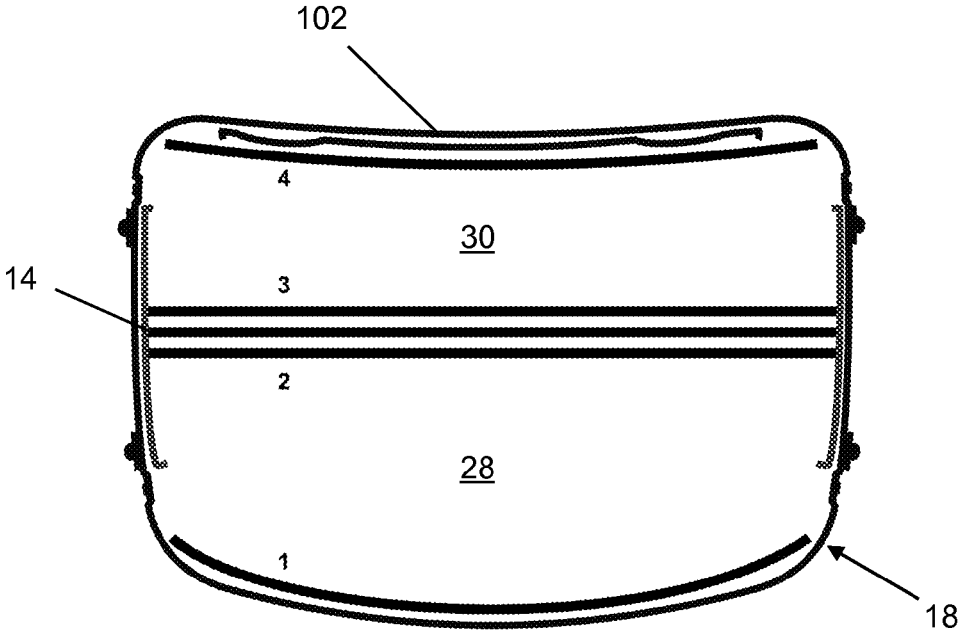
Figure 5D:
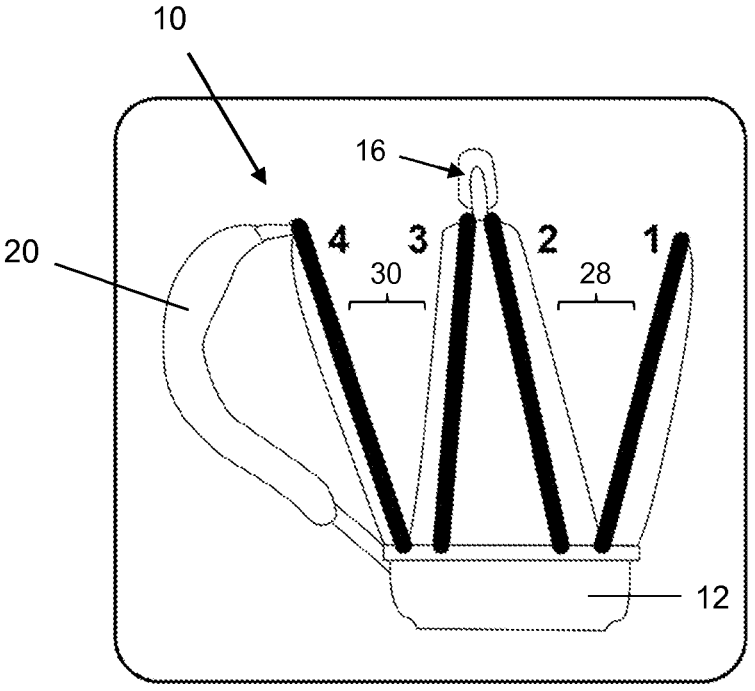

With reference to FIGS. 1-3 and FIG. 5B, the molded plastic base 12 has a configuration specifically designed to improve the fit and function of the pack 10 when worn on the back of a user. The base 12 is higher at the front and tapers to a lower rear lip at the rear of the base. The rear side 102 of the base 12 is concave to conform to the back of the user. The lowered concave rear portion 102 of the base 12 improves the comfort of the pack during use. As best seen in FIG. 5B, the base 12 includes an upstanding lip 52 above a circumferential ridge 104. As shown in FIGS. 1 and 3, the bottom end of the fabric body 18 is surrounded by a folded web 106, which is stitched to the fabric body. Rivets 50 extend through the folded web to secure the fabric body to the base.

The fabric body 18 includes an arch shaped central portion 56 extending between the front and rear panels of the fabric body 18. The central portion 56 of the fabric body is connected to the front and rear panels by the front and rear main zippers 32, 34, respectively. The arch shaped central portion 56 includes a reinforcing web material extending from one side of the base to the other over the top of the pack 10. The sides of the central portion 56 may be provided with various hooks, pockets and attachment points as shown in FIGS. 1-4. The central portion 56 of the fabric body 18 may also include PE sheet sewn between layers provide additional structural support to the fabric body 18. The reinforced central portion 56 of the fabric body 18 provides another load path for weight within the pack extending from the molded base 12 to the handle assembly 16. This load path is in addition to the connection between the handle assembly 16 and base 12 provided by the central support panel 14 and organizational panels 32, 34 as shown in FIG. 5A.

With reference to FIGS. 6 and 12, it will be observed that the central portion 56 of the fabric body 18 is asymmetrical, resulting in a pack shape conducive to use as a backpack. The asymmetrical central portion 56 shifts the rear panel of the pack 10 to a more upright position with respect to the base 12. The rear main zipper 34 meets the lip 52 of the base 12 at an angle A closer to 90° than the front main zipper 32, which meets the lip 52 at angle B as shown in FIG. 12.

Many advantages of the disclosed pack will now be apparent to those skilled in the art. Many choices of materials, components, attachment means and fasteners may be made without departing from the scope of the disclosure. Accordingly the disclosed embodiment is to be construed as illustrative only and not limiting.

What is claimed:

1. A tool pack comprising:

a base defining a rigid support surface and including a peripheral lip;

a support panel substantially perpendicular to said base;

a bag body extending from said peripheral lip to define an interior space surrounding said support panel, said bag body including at least one interior surface having a plurality of pockets, a back panel, and a pair of backpack straps each having an upper portion secured to said back panel adjacent an upper edge thereof and a lower portion secured to said back panel adjacent said peripheral lip permitting the pack to be carried on the back of a user;

a handle assembly coupled to an upper end of said bag body opposite said base, said handle assembly including a handle base coupled to said bag body and a handle pivotably coupled to said handle base;

a pair of adjustable length load positioning straps, each of said load positioning straps extending from one of said backpack straps to said handle base, wherein said support panel divides said interior space into two compartments and said bag body includes a reversible closure mechanism arranged on opposite sides of said handle assembly, with one said closure mechanism intermediate said pair of backpack straps and said handle mechanism, each reversible closure mechanism permitting access to one of said compartments and said load positioning straps spanning the closure mechanism intermediate said pair of backpack straps and said handle mechanism.

2. The tool pack of claim 1, comprising a central portion of said bag body extending between said closure mechanisms, said central portion surrounding said support panel and connecting said base to said handle assembly.

3. The tool pack of claim 1, wherein said support panel has a width and height substantially equal to a width and height of said interior space.

4. The tool pack of claim 1, comprising a plurality of pockets coupled to at least one surface of said support panel.

5. The tool pack of claim 1, wherein said support panel is permanently coupled to both said base and said handle base.

6. The tool pack of claim 1, wherein said base is a substantially rigid concave tub, said peripheral lip extending above said support surface.

7. The tool pack of claim 1, wherein said base includes a bottom defining said support surface, and a side wall extending from said bottom to said peripheral lip.

8. The tool pack of claim 7, wherein said side wall has a height that varies with respect to said support surface.

9. The tool pack of claim 1, wherein said bag body exterior surface including said backpack straps is coupled to said peripheral lip along one side of said base, said peripheral lip and said base having a concave configuration when viewed from outside said interior space.

10. The tool pack of claim 1, wherein said pair of load positioning straps include a coupling for reversibly connecting said backpack straps to said handle base.

11. The tool pack of claim 1, comprising a hasp connected to said pair of load positioning straps, said hasp including a coupling for reversibly connecting said pair of load positioning straps to said handle assembly.

12. A tool pack comprising:

a substantially rigid concave base defining a support surface and including a peripheral wall projecting from said support surface to an upstanding peripheral lip;

a fabric bag body permanently coupled to said peripheral lip to define an interior space, said bag body including a back panel, a pair of backpack straps each having an upper portion secured so said back panel adjacent an upper edge thereof and a lower portion secured to said back panel adjacent said peripheral lip and a plurality of pockets on at least one inside surface;

a generally rigid support panel dividing said interior space into two compartments, said support panel bearing on said base to support said fabric bag body with respect to said base;

a plurality of organizational structures arranged on at least one side of said support panel;

two reversible closure mechanisms in said bag body, each closure mechanism permitting access to one of said compartments;

a central portion of said bag body extending between said closure mechanisms and surrounding a top and sides of said support panel; and a pair of load positioning straps, each of said load positioning straps extending from one of said backpack straps to said central portion of said bag body adjacent the top of said support panel and spanning one of said reversible closure mechanisms.

13. The tool pack of claim 12, comprising a handle mechanism secured to said central portion of said bag body adjacent the top of said support panel, said handle mechanism between said closure mechanisms and generally aligned with said support panel.

14. The tool pack of claim 13, wherein said support panel is coupled to both said base and said handle assembly.

15. The tool pack of claim 12, wherein said load positioning straps are reversibly coupled to said central portion of said bag body and when coupled to said bag body central portion, said load positioning straps connect said backpack straps to said bag body, thereby removing stress from said one of said reversible closure mechanisms.

16. The tool pack of claim 13, comprising a coupling on each load positioning strap permitting the load positioning strap to be reversibly coupled to a base of said handle mechanism.

* * * * *